US005332319A

United States Patent [19]

Brueck

[11] Patent Number: 5,332,319

[45] Date of Patent: Jul. 26, 1994

[54] UNIVERSAL RIBBON RE-INKING APPARATUS

[75] Inventor: William R. Brueck, Chatfield, Minn.

[73] Assignee: Ribbon Recyclers, Inc., Rochester, Minn.

[21] Appl. No.: 999,090

[22] Filed: Dec. 31, 1992

[51] Int. Cl.[5] ..... B41J 31/14

[52] U.S. Cl. ..... 400/200; 400/197; 101/367

[58] Field of Search ..... 400/197–202.4; 101/367, 331, 390, 393, 394

[56] References Cited

U.S. PATENT DOCUMENTS

| | | | |
|---|---|---|---|
| 714,835 | 12/1902 | Tevander | 101/367 |
| 1,245,391 | 11/1917 | Schmidt | 101/367 |
| 2,745,533 | 5/1956 | Keleher | 197/171 |
| 3,733,211 | 5/1973 | Anderson | 117/2 R |
| 3,981,387 | 9/1976 | Gottschlich | 197/168 |
| 3,983,840 | 10/1976 | Francis | 118/235 |
| 4,088,800 | 5/1978 | Nicholson | 427/8 |
| 4,126,715 | 11/1978 | Schiffmacher et al. | 427/141 |
| 4,399,751 | 8/1983 | Kessler | 101/367 |
| 4,419,956 | 12/1983 | Kwok-Fai | 118/235 |
| 5,005,997 | 4/1991 | Chung | 400/197 |
| 5,035,522 | 7/1991 | Wright | 400/197 |
| 5,071,271 | 12/1991 | Chang et al. | 400/200 |
| 5,190,385 | 3/1993 | Taguchi et al. | 400/200 |

*Primary Examiner*—Edgar S. Burr
*Assistant Examiner*—Lynn D. Hendrickson
*Attorney, Agent, or Firm*—Newrocki, Rooney & Sievertson

[57] ABSTRACT

Apparatus for re-inking a ribbon utilized in a typewriter computer printer, cash register, or other printing device. The apparatus incorporates design features which make the apparatus universally adjustable to accommodate ribbon cartridges or spools of varying design. The apparatus includes a drive motor and a take-up motor with independently variable speeds to adjust the rate of re-inking apart from the cartridge advancement mechanism to maximize the volume of ribbons which may be re-inked.

18 Claims, 2 Drawing Sheets

UNIVERSAL RIBBON RE-INKING APPARATUS

TECHNICAL FIELD

The present invention relates to an apparatus for re-inking a ribbon utilized in a typewriter, computer printer, cash register, or other printing device. More narrowly, it is directed to a universal re-inking apparatus capable of being adjusted to fit ribbon cartridges of varying size, design, and width while allowing for a variable rate of re-inking to maximize ribbon throughput for a particular design.

BACKGROUND OF THE INVENTION

Printing equipments, as utilized in homes or businesses, include an inked ribbon designed to supply a relatively consistent quantity of ink to the surface (i.e., paper) on which the device is printing over an extended period of time. The design of cartridges housing such ribbons varies from device to device and from manufacturer to manufacturer, with no industry standard that allows interchangeability.

As disclosed by Schiffmacher et al. (U.S. Pat. No. 4,126,715), older typewriters or similar machines utilized a double spool-type ribbon. With this type, the ribbon is wound around one of two spools, both of which are inserted at opposite sides of the printing mechanism with one such spool being driven by the printing device during use to advance the ribbon from the other spool. Such a construction functions to expose different areas of the ribbon to the printing mechanism. When all of the ribbon is transferred from one spool to the other, the operation is reversed.

As disclosed by Gottschlich (U.S. Pat. No. 3,981,387), the more recent trend in typewriter and business machine designs is to incorporate an ink ribbon in a disposable cartridge or cassette which can be readily installed and/or replaced in such printing machines. The operator of such machines merely removes the old cartridge when the ink on the ribbon is used up. The cartridge usually has feed means therein which cooperate with a driving member on the machine on which the cartridge is installed so as to transport the ribbon in the cartridge and thereby provide a fresh supply of ink to the print head located on the machine.

Among the cartridges and spool-type ribbons now available on the market, the size and design varies substantially. Some of these ribbon cartridges employ two reels therein on which the ribbon is alternately wound and unwound when used. This construction is similar to the older two-spool typewriter ribbons.

Other cartridges, most of which are presently available on the market, employ only one special reel or spool on which an endless ink ribbon is wound, and, as the reel rotates, the ribbon winds up on the outer turn of the ribbon on the reel. The ribbon is then withdrawn from the innermost turn of the ribbon from the reel.

Another type of cartridge employs a length of inked ribbon which is formed into an endless loop of ribbon which is not stored on any reel or reels within a cartridge, but is simply stuffed therein to produce many folds or convolutions in the ribbon. In this type of cartridge, the ribbon is simply fed into or stuffed into the cartridge by feed means located at an entrance of the cartridge and is pulled out of an exit area of the cartridge by the feed means as the ribbon is stuffed into the cartridge.

As recognized by Schiffmacher et al., many of the typewriting cartridges which are presently on the market contain a winding or rewinding and reloading mechanism which is extremely fragile and designed for short life during the one time use of the cartridge. Attempts to re-ink this type of cartridge by existing methods usually cause breakage which negates any possible savings.

Common to all printing device ribbons is a limited useful life. The ink available for printing in any cartridge or spool is depleted by use until a point at which the print quality becomes unacceptable. At this time, the user must decide whether to simply discard the cartridge and replace it with a new cartridge or utilize a recycling-type program in which the ribbons are re-inked for reuse. Both economic and environmental factors must be considered.

When considering the economics of re-inking a used printing device cartridge or spool, the user weighs purchasing equipment for re-inking such ribbons against sending them to an outside firm which supplies re-inking services. In either case, the cost of re-inking includes the price of equipment plus labor costs. Equipment costs will be a function of the number of re-inking devices which must be purchased to accommodate the various cartridge designs used in printing devices at any business. Labor costs will fluctuate with the speed at which a particular re-inking device can accomplish the re-inking procedure. These same factors affect the charges which would be made by an outside firm providing re-inking services.

Another factor providing impetus for recycling and re-inking ribbons is the continued rising costs of disposal or incineration of discarded waste. Both these costs and increasing environmental awareness by companies lead to a desire to re-ink used cartridges.

As discussed above, the ribbon cartridges utilized in printing devices vary dramatically in design from manufacturer to manufacturer and machine to machine. This includes variations in configuration, with some cartridges feeding from left to right while others feed from right to left. There are also variations in the location and design of the mechanism which advances the ribbon. Further, the ribbon advancement mechanism within most cartridges limits the rate at which re-inking may take place if the operation is controlled by such a mechanism. These mechanisms also have slippage in the advancement of the ribbon which leads to inconsistent re-inking due to a non-constant rate of advancement.

Presently available re-inking devices are limited in their ability to be adjusted to handle all of the variations in design outlined above. Thus, a business utilizing several different types of printing devices or the service company providing re-inking services to such businesses must purchase several re-inking devices to maintain a complete recycling program.

Generally, presently available re-inking devices include only a single one-direction motor without adjustable speed. Since the speed is not adjustable, the motor is preset at a low speed, while many cartridges may be re-inked at higher speeds. Further, without a positive drive motor, the advancement of the ribbon is dependent on the cartridge advancement mechanism.

Accordingly, the need exists for a universal ribbon re-inking apparatus for re-inking a ribbon utilized in a typewriter, computer printer, cash register, or other printing device. The needed universal re-inking apparatus should be readily adjustable to accommodate spools and cartridges of left-hand or right-hand design with various ribbon widths. Finally, the ribbon re-inking apparatus should include both a drive motor and a take-up motor which allow bypassing the ribbon advancement mechanism integral to the cartridge so that speed may be adjusted to minimize the time required to re-ink such ribbons.

The present invention addresses these needs as well as other problems associated with existing ribbon re-inking devices. The present invention also offers further advantages over the prior art and solves other problems associated therewith.

SUMMARY OF THE INVENTION

The present invention is a device for re-inking a ribbon utilized in a typewriter, computer printer, cash register, or other printing device. It is specifically designed and intended for use with many different designs of ribbon cartridges or spools. These cartridges or ribbons may be of left-hand or right-hand design. Thus, some cartridges and machines in which they are used are designed to advance the ribbon from left to right while others are designed to advance the ribbon from right to left.

The universal ribbon re-inking apparatus of the present invention includes a base having a forward edge. This edge defines, in part, the perimeter of an upper planar surface which has a plurality of generally parallel-spaced channels formed therein. The channels extend generally parallel to the forward edge of the base. A drive motor is fixedly mounted proximate the forward edge, the motor including means for supporting and advancing the ribbon in a plane generally parallel to the upper planar surface of the base.

In one embodiment, the drive means on the drive motor can include a pair of meshing rollers. The first roller is driven by the drive motor, and the second roller is releasably held in tension by the first roller with the ribbon traveling between these rollers.

The device includes means for supporting a ribbon carrier in the same plane as the drive means, with the ribbon extended from the carrier, such as a cartridge or spool, through the means for supporting and advancing the ribbon on the drive motor. The means for supporting the cartridge or spool are releasably secured to the planar surface of the base at a location within the plurality of generally parallel-spaced channels.

In a preferred embodiment, the plurality of generally parallel-spaced channels have a perpendicular cross-section in the shape of an inverted T. The means for releasably securing the means for supporting the ribbon at a location in these channels is a T-nut slidably fitted within the channel and threadedly connected to a support post. The support post, in conjunction with a clip, is utilized to mount the cartridge.

A second motor, a take-up motor, is releasably secured to the upper planar surface at a location within the plurality of generally parallel-spaced channels in a like manner to the support posts. The take-up motor may be moved to any location within the channels to accommodate varying ribbon designs. This is particularly important for adjusting the apparatus to accommodate left-hand or right-hand ribbon designs. Means for rotatably coupling the take-up motor to a take-up spool within the cartridge or spool to be re-inked is included.

The present device also includes means for applying ink to the ribbon which is releasably secured proximate the upper planar surface. The applying means is contacted by the ribbon as it extends from the cartridge or spool to the take-up spool. The means for applying ink is in contact with the ribbon within the horizontal plane parallel to the upper planar surface of the base.

In one embodiment, the take-up motor drive terminates in a square socket. Such a socket allows interchanging tools which are specifically designed to couple the take-up motor to the drive mechanism within the cartridge or spool. In a preferred embodiment, the means for rotatably coupling the take-up motor to the take-up spool within the cartridge spool includes a slip clutch. The slip clutch is utilized to maintain constant tension on the ribbon as it is extracted from the cartridge by the drive motor and prior to being rewound on the take-up spool.

In a preferred embodiment, the means for applying ink to the ribbon is of a design which includes a first vertically-mounted, hollow, cylindrical tube which has an upper end and a lower end. The tube is sealed on the lower end and has a plurality of aligned axially-spaced holes proximate the upper end. A second hollow circular tube having both an upper end and a lower end includes a plurality of parallel, circumferentially-spaced rows of holes proximate the lower end of the second tube. The number of spaced holes in a row is different at each circumferential location, the overall axial length of each row of holes being different from an adjacent row.

When assembled, the second tube is inserted into the first tube to a point where the plurality of holes on the first tube can be registered with a row of spaced holes at each of the circumferential locations on the second tube as the second tube is rotated relative to the first tube. Thus, the amount of ink to be applied to a ribbon of a given width may be set by rotating the second tube to a point wherein the proper hole row length, as determined by the number of holes in the second tube, is registered with the holes in the first tube. The inside diameter of the first tube and the outside diameter of the second tube are machined to sealably contact each other when the second tube is inserted into the first tube.

In another embodiment, the apparatus includes means for independently varying the speed of both the drive motor and the take-up motor. This allows for minimizing the amount of time necessary to re-ink a cartridge based on the specific design of that cartridge. Further, the drive motor and take-up motor can be reversible to accommodate design variations.

These and various other advantages and features of novelty which characterize the present invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there are illustrated and described preferred embodiments of the present invention.

BRIEF DESCRIPTION OF THE DRAWINGS

In the drawings, in which like reference numerals indicate corresponding parts or elements of preferred embodiments of the present invention throughout the several views.

DETAILED DESCRIPTION OF THE INVENTION

As required, detailed embodiments of the present invention are disclosed herein. However, it is to be understood that the disclosed embodiments are merely exemplary of the present invention which may be embodied in various systems. Therefore, specific details disclosed herein are not to be interpreted as limiting, but rather as a basis for the claims and as a representative basis for teaching one skilled in the art to variously practice the present invention.

Figure 1:
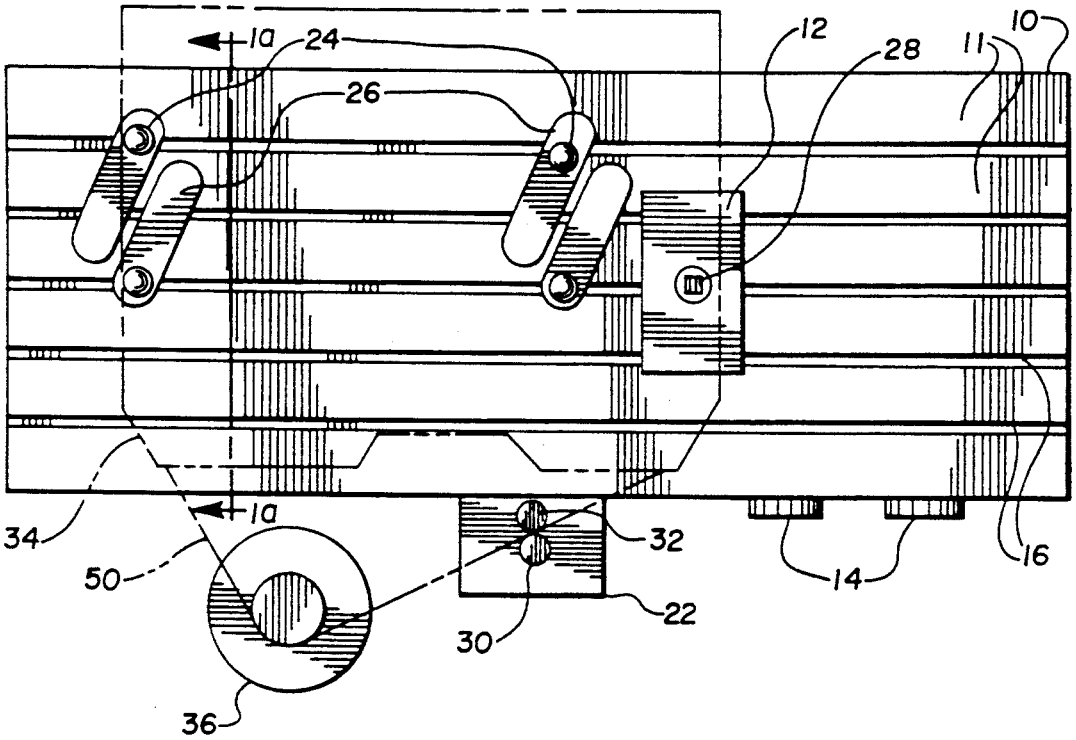
FIG. 1 is a top plan view of the ribbon re-inking apparatus of the present invention.

Referring now to FIG. 1, a top plan view of a preferred embodiment of the re-inking apparatus of the present invention is depicted. The apparatus includes a base 10 with the outer perimeter defined by a forward edge, a rear edge, a left-side edge and a right-side edge. These edges define the perimeter of a planar surface 11 on the upper surface of the base 10. The planar surface 11 has formed therein a plurality of generally parallel, spaced channels 16 parallel to the forward edge of the base 10. The base 10, also referred to as a table, could be made of any suitable material such as aluminum or other metal, although Applicant believes that molded plastic is preferable. The base 10, it is envisioned, is approximately two inches high and supported by legs.

A drive motor 22 is fixedly mounted proximate the forward edge of the base 10 generally centrally therealong. The drive motor 10 includes means for supporting and advancing a ribbon 50. In a preferred embodiment depicted in FIG. 1, the means for supporting and advancing the ribbon 50 includes a pair of rollers 30, 32. These are preferably a pair of serrated meshing rollers.

The first of said rollers is a drive roller 30 which is driven by the drive motor 22. The second of said rollers is a non-driving roller 32 which is releasably held in tension against the drive roller 30. In operation, the ribbon 50 is held between the pair of rollers 30, 32.

The apparatus also includes means for supporting a ribbon cartridge 34 or spool in a plane generally parallel to the planar surface 11. As depicted in FIG. 1, the means for supporting the cartridge 34 or spool includes support posts 24 and clips 26 which are releasably secured to the planar surface 11 at a point within the plurality of generally parallel, spaced channels 16.

Figure 1A:
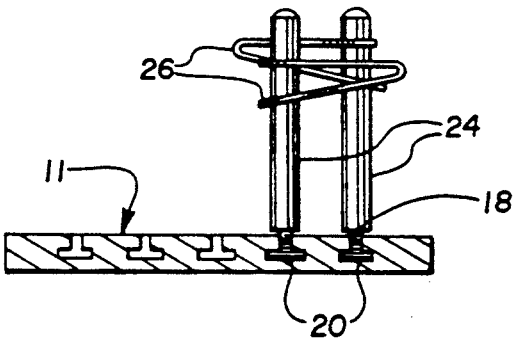
FIG. 1*a* is a sectional view of the ribbon re-inking apparatus of the present invention taken generally along line la-la in FIG. 1.

Referring to FIG. 1*a*, there is depicted a sectional view of the apparatus shown in FIG. 1. This figure clearly shows the means for supporting the cartridge 34 or spool and the way in which the supporting means is releasably secured to the planar surface 11 at locations within the plurality of generally parallel-spaced channels 16. In this view, it can be seen that the shape of the channels as depicted by the perpendicular cross-section is that of an inverted T. It will be understood, however, that any channel shape which allows releasably securing the supports to the channel 16 may be utilized.

In the preferred embodiment, T-shaped nuts 20 are slidably fitted within the channels 16. A support post 24 is then threadedly connected to the T-nut 20 so that, when the post 24 is tightened, it presses against the planar surface 11 to secure the support post 24 at a point on the planar surface 11 within the channel 16.

The clips 26 provide altitudinal support for a ribbon cartridge 34 as well as keeping the cartridge 34 from rotating due to the torque created during re-inking of the ribbon 50. Some cartridges 34 may require downward pressure to keep them engaged with the re-inking apparatus. A clip 26 may be easily removed from a support post 24 and reinserted upside down to provide downward pressure. In some embodiments, the clips 26 are of spring steel such that they may be pinched to allow them to move altitudinally on the support post 24.

Referring back to FIG. 1, the apparatus of the present invention also includes a second motor, a take-up motor 12. The take-up motor 12 is releasably secured to the planar surface 11 at a location within the plurality of generally parallel-spaced channels 16. The take-up motor 12 includes a means 28 for rotatably coupling the take-up motor 12 to a take-up spool on the ribbon cartridge 34.

The drive motor 22 and the take-up motor 12 are of conventional design. The motors are preferably of variable speed and reversible to contribute to the universality of the overall apparatus for adjusting to re-inking cartridges or spools of various designs.

As depicted in FIG. 1, control knobs 14 may be located on the forward edge of the base 10 to adjust the speed of the drive motor 22 and take-up motor 12 during re-inking operations. The means for varying the speed of each motor are conventionally known.

The means for coupling the take-up motor 12 to the take-up spool on a cartridge or spool can include a square socket 28 into which interchangeable tools may be inserted. Such tools are specifically designed to properly couple with a given cartridge take-up spool. Means 28 may also include a slip clutch (not shown) which could maintain constant tension on the ribbon 50 during a re-inking procedure. This slip clutch compensates and corrects for any differential between the rate of extraction of the ribbon from the cartridge by the drive motor 22 versus the rate at which the ribbon is rewound on the cartridge by the take-up motor 12.

The apparatus also includes an ink delivery system 36 for re-inking the ribbon when the apparatus is in use. In a preferred embodiment, the ink delivery system 36 is not physically attached to the base 10. Rather, the ink delivery system has a base of its own and is free standing. Thus, the ink delivery system may be placed at a location either before or after the drive motor 22. It is believed that the ink will be better distributed if it is applied before the ribbon enters between the rollers 30, 32.

FIG. 1, also depicts the apparatus of the present invention showing a ribbon cartridge 34, in phantom, mounted on base 10 at a position it would typically occupy. The cartridge is maintained so as to define a plane generally parallel to the planar surface 11 of the base 10. The ribbon 50 is extended out of the cartridge in a continuous loop, being maintained in the same horizontal plane as the cartridge 34. In normal operation, the ribbon 50 passes over and contacts the ink delivery system 36. The ribbon then passes into a nip between the drive wheel 30 and non-drive wheel 32 on the drive motor 22. Thus, the drive motor functions to pull the ribbon 50 out of the cartridge 34. The take-up motor 12, as coupled to the take-up spool on the cartridge, functions to rewind the ribbon 50 as it passes beyond rollers 30, 32. During a re-inking operation, the speeds of the drive motor 22 and take-up motor 12 are varied on the basis of the cartridge being re-inked. This is done to maximize the speed at which the re-inking operation may be completed. It will be understood that the speed for re-inking a given cartridge must be determined based upon experience with re-inking a specific cartridge or spool design.

Figure 2:
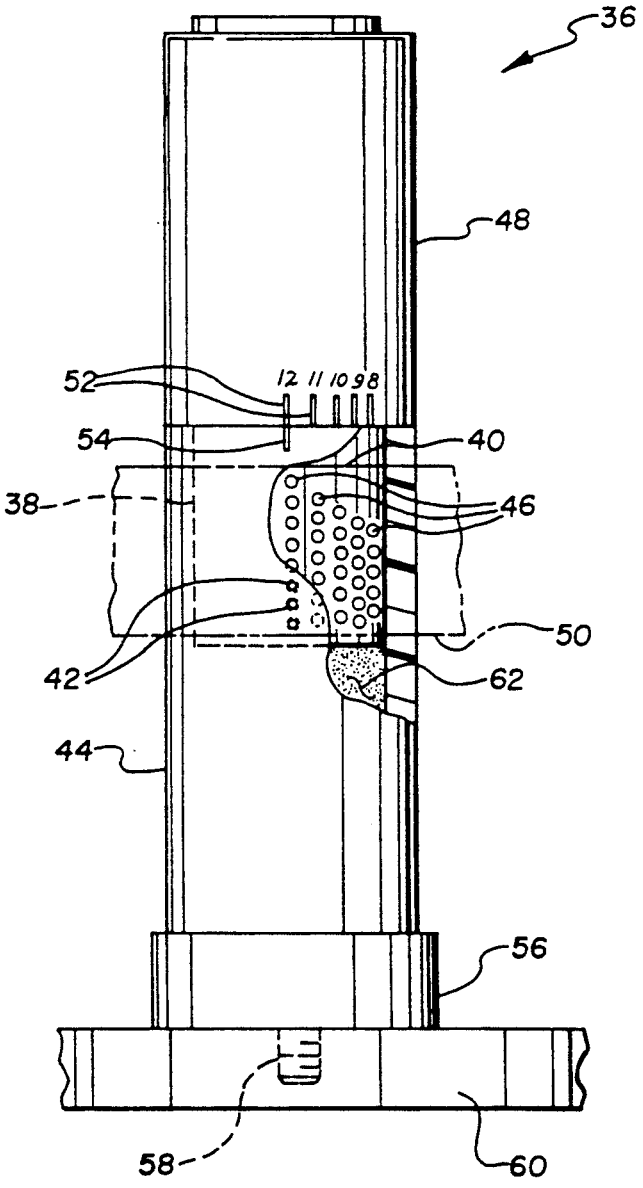
FIG. 2 is a fragmentary side elevational view of the preferred means for applying ink to a ribbon.

Now referring to FIG. 2, a fragmentary side elevational view of the ink delivery system 36 of a preferred embodiment is depicted. The means for applying ink to the ribbon includes a first hollow, cylindrical tube 44 having an upper end and a lower end. The tube is sealed on the lower end by a cap 56. Tube 44 further includes a plurality of axially-spaced holes 42.

The means for applying ink 36 also includes a second hollow, cylindrical tube 48 having an upper end and a lower end. The second tube 48 has a plurality of parallel, axially-extending rows of spaced holes 46 proximate the lower end of the second tube 48. The number of vertically-spaced holes 46 in each row varies in order to enable changing the overall length of a row registered with holes 42.

The second tube 48 is inserted into the first tube 44 to a point where the plurality of axially-spaced holes 42 on the first tube 44 are registered with a row of holes 46 on the second tube 48. In operation, the second tube 48 is rotated relative to the first tube 44 to positions wherein a different row of holes 46 are in registration with the holes 42 on the first tube 44. In this way, the overall amount of the ink which is being distributed is varied to accommodate a different width of ribbon 50.

In a preferred embodiment, the ink delivery system 36 is constructed of machined steel. The inside diameter surface 38 of the first tube 44 and the outside diameter surface 40 of the second tube 48 are machined so that, when assembled, the surfaces sealably contact each other to prevent leakage of the ink. Preferably the holes 42 on the first tube 44 are small #60 holes which regulate the rate of ink delivery. The holes 46 on the second tube 48 are oversized to allow for easier registration for full ink flow through the outer holes 42. When assembled, the two tubes 44, 48 define a reservoir to which ink may be added. In operation, the ribbon 50 wipes the ink from the outer holes 42 by advancing past the ink delivery system 36.

A sufficient distance between the circumferential locations of rows of holes 46 is provided to permit the ink flow to be stopped completely by turning the inner tube 48 to a position between the rows of holes 46. Index marks 52 can be provided on the second tube 48 to define the location of a desired set of circumferentially-located holes 46.

In a preferred embodiment, the first tube 44 is provided with a floor 56 which is drilled and fitted with a threaded bolt 58 for attachment to a base 60. The lower part of the first tube 44 can be filled with epoxy 62 to a point proximate the lowest vertically-spaced hole 42.

New characteristics and advantages of the invention covered by this document have been set forth in the foregoing description. It will be understood, however, that this disclosure is, in many respects, only illustrative. Changes may be made in details, particularly in matters of shape, size, and arrangement of parts, without exceeding the scope of the invention. The invention scope is, of course, defined in the language in which the appended claims are expressed.

What is claimed is:

1. A universal ribbon re-inking apparatus for re-inking a ribbon utilized in a typewriter, computer printer or cash register, said universal ribbon re-inking apparatus including a ribbon, said ribbon further including a carrier having said ribbon wound thereon of left hand or right hand design comprising:

(a) a base including an upper planar surface having therein a plurality of generally parallel-spaced channels parallel to a forward edge of said base;

(b) ribbon drive means fixedly mounted proximate said forward edge;

(c) means for supporting said carrier in a plane generally parallel to said upper planar surface, wherein said ribbon is extended from said carrier through said ribbon drive means, said means for supporting said carrier being releasably secured to said upper planar surface in a disposition within said plurality of generally parallel-spaced channels;

(d) a take-up motor releasably secured to said planar surface in a disposition within said plurality of generally parallel-spaced channels, and having means for rotatably coupling a take-up spool of said carrier, as supported in said horizontal plane, with said ribbon extending from said carrier through said ribbon drive means and back to said take-up spool; and (e) means for applying ink to said ribbon, said means releasably secured proximate said upper planar surface and in contact with said ribbon extending from said carrier to said take-up spool.

2. The universal ribbon re-inking apparatus of claim 1, wherein said means for applying ink to said ribbon comprises:

(a) a first hollow circular tube mounted generally perpendicular to said upper planar surface and having an upper end and a lower end and a row of axially-aligned holes proximate said upper end, holes within said row being spaced along an axis of said tube, said tube sealed on said lower end;

(b) a second vertically mounted hollow circular tube having an upper end and a lower end, said tube having a plurality of generally parallel rows of holes proximate said lower end of said second tube, holes within one row being spaced axially along said second tube, said rows being spaced circumferentially around the tube such that the number of axially-spaced holes in one row is different than the number of holes in another row to vary the overall axial lengths of the rows of holes;

(c) wherein, when said second tube is fitted into said first tube such that the row of holes on said first tube are axially coextensive with the holes on said second tube, rotation of said second tube relative to said first tube varies the length of effective ink distribution.

3. The universal re-inking apparatus of claim 2, wherein the means for applying ink to said ribbon is releasably secured proximate said upper planar surface at a location such that said ribbon, as it is driven, engages said means for applying ink prior to engaging said drive means.

4. The universal re-inking apparatus of claim 1, wherein said plurality of generally parallel-spaced channels extend from a left side edge to a right side edge of the upper planar surface parallel to said forward edge.

5. The universal re-inking apparatus of claim 4 wherein a cross-section of each of said plurality of generally parallel-spaced channels is in the shape of an inverted T.

6. The universal re-inking apparatus of claim 5 wherein the means for supporting said carrier comprises a T-nut slidably receivable within a channel, and a support post, threadably connectable to said T-nut.

7. The universal re-inking apparatus of claim 1 wherein said ribbon drive means comprises:

(a) a drive motor; and (b) a pair of engaged rollers defining a nip into which he ribbon is fed, a first of said rollers driven by said drive motor and the second of said rollers releasably held in tension against said first roller with said ribbon held therebetween.

8. The universal re-inking of claim 7 further comprising means for independently varying the speeds of said drive motor and said take-up motor.

9. Universal apparatus for re-inking a ribbon cartridge including a ribbon, said universal apparatus including a ribbon cartridge mounted thereon, wherein substantially all of said ribbon is wound around at least one spool with a portion of said ribbon extending in a continuous loop outside said cartridge for advancement past a printing element of a printing device, said cartridge further including a means for advancing said ribbon and said continuous loop past said printing element, comprising:

(a) a base including four vertical edges defining the perimeter of an upper planar surface having therein a plurality of generally parallel-spaced channels extending generally parallel to a forward edge of said upper planar surface;

(b) means for supporting said ribbon cartridge in a horizontal plane parallel to the normal path of advancement of said continuous loop, said supporting means being releasably secured at a location within said plurality of generally parallel-spaced channels;

(c) a drive motor fixedly connected to said base and having drive means operably connected to said ribbon when said continuous loop is extended outward from said cartridge through said drive means for continuously pulling said ribbon out of said cartridge during re-inking;

(d) a take-up motor releasably secured to said planar surface at a location within said plurality of generally parallel-spaced channels, said take-up motor having means for rotatably coupling to said means for advancing said ribbon on said cartridge, for rewinding ribbon advanced by said drive motor back into said cartridge; and (e) means for applying ink to said ribbon, said applying means releasably secured proximate said planar surface in contact with said ribbon at a point along said continuous loop outside said cartridge.

10. The universal ribbon re-inking apparatus of claim 9, wherein said means for applying ink to said ribbon comprises:

(a) a first vertically mounted hollow circular tube having an upper end and a lower end, said tube sealed on said lower end and further having a plurality of parallel vertically-spaced holes proximate said upper end;

(b) a second vertically mounted hollow circular tube having an upper end and a lower end, said tube having a plurality of parallel vertically-spaced holes proximate said lower end at a plurality of locations spaced circumferentially around the tube wherein the number of vertically-spaced holes is different at each circumferential location to vary the overall vertical length of each plurality of parallel vertically-spaced holes wherein said second tube is inserted into said first tube to a point wherein the plurality of parallel vertically-spaced holes on said first tube are aligned with said plurality of parallel vertically-spaced holes at each of said plurality of circumferential locations on said second tube upon rotating said second tube relative to said first tube to allow varying the vertical length of ink distribution from said means for applying ink.

11. The universal re-inking apparatus of claim 10, wherein the means for applying ink to said ribbon is releasably secured at a point proximate said planar surface for contact with said ribbon prior to said ribbon passing through said drive means.

12. The universal re-inking apparatus of claim 9 wherein the drive means on said drive motor comprises:

a pair of serrated meshing rollers, with the first of said rollers driven by said drive motor and the second of said rollers releasably held in tension against said first roller with said ribbon held therebetween.

13. The universal re-inking apparatus of claim 12 further comprising means for independently varying the speed of said drive motor and said take-up motor.

14. The universal re-inking apparatus of claim 9, wherein said plurality of generally parallel-spaced channels extend across the entire upper planar surface parallel to said forward edge.

15. The universal re-inking apparatus of claim 14 wherein the perpendicular cross-section of each of said plurality of generally parallel-spaced channels is in the shape of an inverted T.

16. The universal re-inking apparatus of claim 15 wherein the means for releasably securing said means for supporting said ribbon at a point in said plurality of generally parallel-spaced channels is a T-nut slidably fitted within said channel and threadedly connected to a support post.

17. A universal ribbon re-inking distributor for applying ink to a ribbon, comprising:

(a) a first vertically mounted hollow circular tube having an upper end and a lower end, said tube sealed on said lower end and further having a plurality of parallel vertically-spaced holes proximate said upper end;

(b) a second vertically mounted hollow circular tube having an upper end and a lower end, said tube having a plurality of parallel vertically-spaced holes proximate said lower end at a plurality of locations spaced circumferentially around the tube, wherein the number of vertically-spaced holes is different at each circumferential location to vary the overall vertical length of each plurality of parallel vertically-spaced holes, wherein said second tube is inserted into said first tube to a point wherein the plurality of parallel vertically-spaced holes said first tube are aligned with said plurality of parallel vertically-spaced holes at each of said plurality of circumferential locations on said second tube upon rotating said second tube relative to said first tube to allow varying the vertical length of ink distribution from said means for applying ink.

18. The universal ribbon re-inking distributor of claim 17 wherein the inside diameter of said first tube and the outside diameter of said second tube are machined to sealable contact each other when said second tube is inserted into said first tube.

* * * * *